US005931109A

United States Patent [19]

Hill

[11] Patent Number: 5,931,109

[45] Date of Patent: Aug. 3, 1999

[54] SAIL

[75] Inventor: Robert C. F. Hill, England, United Kingdom

[73] Assignee: Altosail Limited, Bath, United Kingdom

[21] Appl. No.: 08/877,149

[22] Filed: Jun. 17, 1997

[51] Int. Cl.[6] ..... B63H 9/04

[52] U.S. Cl. ..... 114/102.22

[58] Field of Search ..... 114/39.1, 102, 114/103, 102.22

[56] References Cited

U.S. PATENT DOCUMENTS 4,741,282 5/1988 Duke ..... 114/103

4,753,186 6/1988 Paras ..... 114/103

FOREIGN PATENT DOCUMENTS 3211641 10/1983 Germany ..... 114/103

*Primary Examiner*—Ed L. Swinehart

*Attorney, Agent, or Firm*—Hopgood, Calimafde, Kalil & Judlowe

[57] ABSTRACT

A sail, according to one aspect of the present invention, comprises an inner membrane and two outer membranes, each attached substantially around the periphery of a respective side of the sail to form a respective pocket. The camber of the inner membrane is less than that of the outer sails so that, during use, the sail adopts an airfoil cross section. An inflatable compartment is provided adjacent the luff edge of the sail.

23 Claims, 15 Drawing Sheets

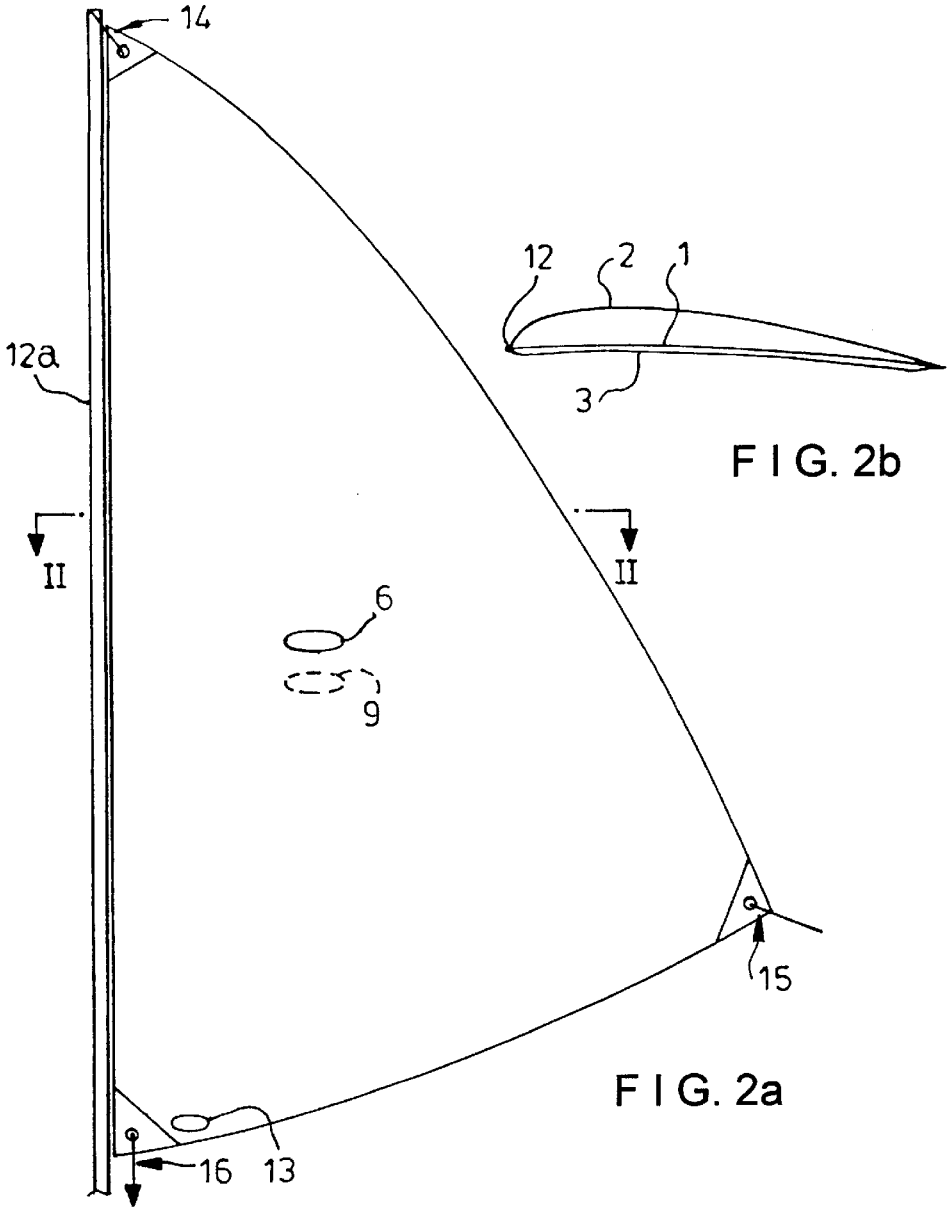
FIG. 2b
FIG. 2a
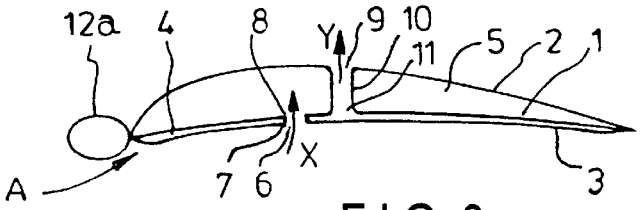
FIG. 3a
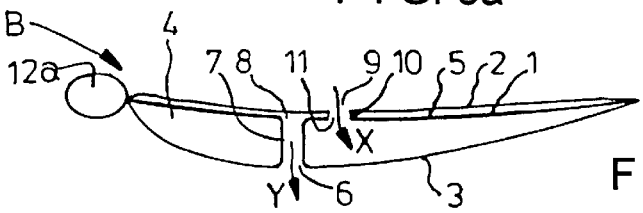
FIG. 3b

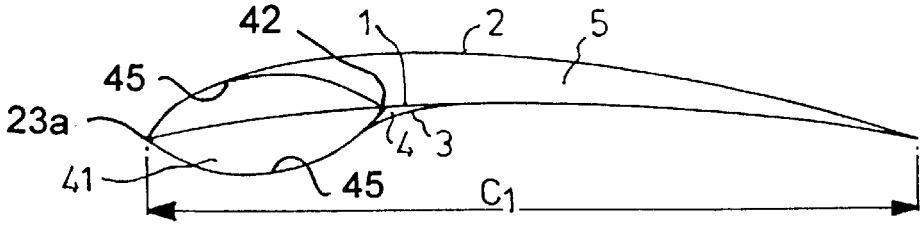
FIG. 14a
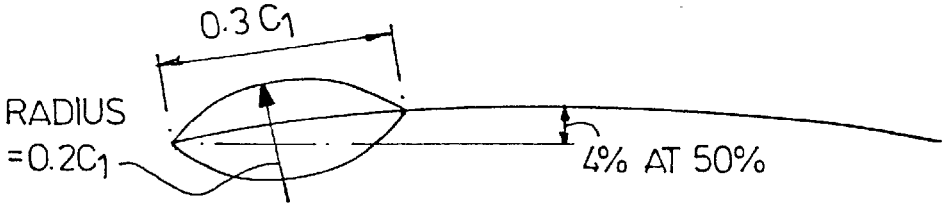
FIG. 14b
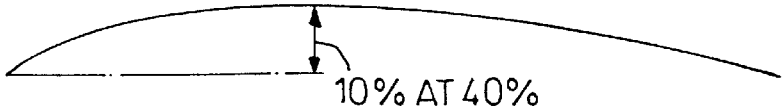
FIG. 14c
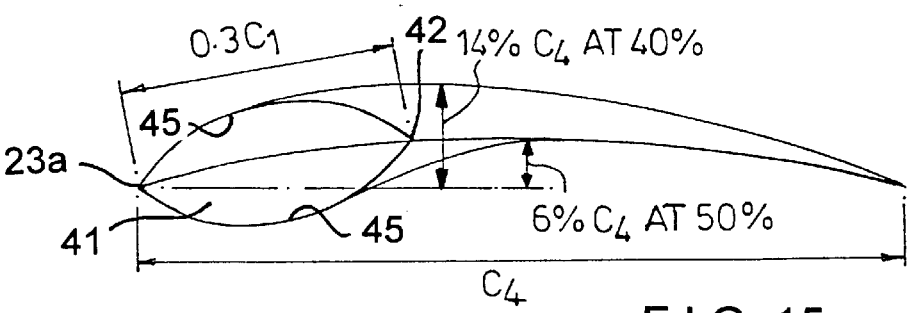
FIG. 15a
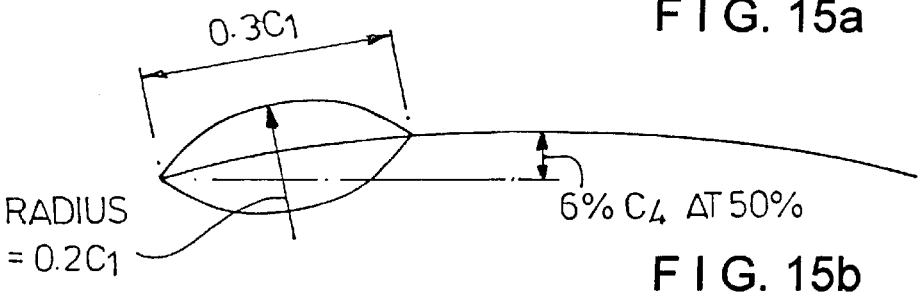
FIG. 15b
FIG. 15c
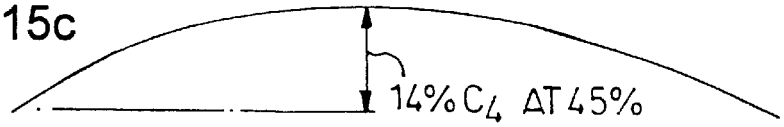

SAIL

BACKGROUND OF THE INVENTION

The present invention relates generally to means for propelling vessels through fluid media and, more particularly, to a sail having improved aerodynamic characteristics and a method of shaping the same.

The performance of a sail boat, for instance, is determined substantially by the aerodynamic efficiency of the sail. A conventional sail comprising a single membrane of material adopts, in use, a curved shape similar to the shape of an airfoil. The efficiency of such sail, however, is limited by its thickness, i.e., the sail does not form to a full airfoil section.

Attempts have been made to provide a more efficient sail having an airfoil cross section, by constructing the sail in the form of a rigid or semi-rigid wing comprising a covering stretched over a framework. Since an airfoil cross section is asymmetric, however, such arrangements have included either an articulation allows the sail to change shape, or a pivot mechanism which allows the sail to be inverted, for the sail to be used efficiently on both tacks. The resulting mechanisms have been found structurally complex, heavy and expensive.

Other arrangements have attempted to provide a sail having an approximate airfoil cross section using a wide mast in combination with a single or double membrane sail. Although useful, such arrangements have required the expense and weight of a special mast construction and have been applicable only to sails supported up the luff by a mast.

SUMMARY OF THE INVENTION

It is therefore an object of the present invention to provide a sail having improved aerodynamic performance.

Another object of the present invention is to provide a durable, economical and reliable means for propelling a vessel through fluid media.

A further object of the present invention is to provide a simple, lightweight and efficient sail which is appropriate to a wide variety of sailing applications.

According to one aspect of the present invention is a sail having an inner membrane and an outer membrane attached to the inner membrane. Each outer membrane forms, with the inner membrane, an inflatable pocket. The camber of the inner membrane is less than that of the outer membranes, wherein an inflatable compartment is provided adjacent the luff edge of the sail.

In accordance with another aspect of the present invention is a sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail.

According to a further aspect of the present invention, there is provided a sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the compartment having at least one pocket, the inner membrane being substantially impermeable to air and each pocket including a vent arranged to permit the flow of air into and out of the pocket.

According to another embodiment, a sail is provided comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the outer membranes being substantially impermeable to air and the inner membrane being adapted to allow air to flow through it from one pocket to the other.

According to yet another aspect of the present invention is a sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the sail further including at least one flexible rib extending between the inner membrane and each outer membrane, the sail further including at least one flexible rib extending between the inner membrane and each outer membrane.

According to still another aspect of the invention, there is provided a sail comprising an inner membrane and, on either side thereof, an outer membrane attached to the inner membrane, each outer membrane forming with the inner membrane an unsealed. inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the compartment having at least one pocket and each pocket including an air vent positioned adjacent the luff edge of the sail.

In accordance with yet a further embodiment, a sail comprises an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the compartment having at least one pocket and each pocket including an air vent positioned adjacent the luff edge of the sail, and pocket also being divided into at least two compartments, the forward compartment including the air vent positioned adjacent the luff edge of the sail.

Another embodiment is a method of shaping a sail comprising an inner membrane and, on each side thereof, an outer membrane attached to the inner membrane, each outer membrane forming, with the inner membrane, an inflatable pocket, the sail further including a sealable inflatable compartment adjacent the luff edge, the method comprising inflating the sealable inflatable compartment before use to increase the thickness of the sail adjacent the luff edge and inflating the pocket on the leeward side of the sail by means of the pressure difference across the sail to increase the thickness of the sail.

Still another aspect of the present invention is a sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, at least one outer membrane having a fairing flap extending around a forward surface of a mast so as to form an airfoil leading edge at the mast forward surface.

Yet a further aspect of the present invention is a sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, at least one outer membrane having a fairing flap extending around a forward surface of a mast so as to form an airfoil leading edge at the mast forward surface, an open-ended pocket being positioned at the airfoil leading edge.

The present invention will now be further described by reference to the following drawings which are not intended to limit the accompanying claims.

BRIEF DESCRIPTION OF THE DRAWINGS

FIG. 2*a* is a plan view of a hoisted sail, according to yet another aspect of the present invention;

FIG. 2*b* is a sectional view taken along line II—II of FIG. 2*a;*

FIGS. 3*a* and 3*b* are cross sectional views illustrating operation of the sail in FIG. 2*a;*

FIGS. 14*a*, 14*b* and 14*c* are sectional views taken along XIV—XIV of FIG. 13*a* showing, respectively, sections of the complete sail, the inner membrane and luff tubes, and an outer membrane;

FIGS. 15*a*, 15*b* and 15*c* are sectional views taken along lines XV—XV of FIG. 13, showing, respectively, sections of the complete sail, the inner membrane and luff tubes, and an outer membrane;

The same numerals are used throughout the figure drawings to designate similar elements. Still other objects and advantages of the present invention will become apparent from the following description of the preferred embodiments.

DETAILED DESCRIPTION OF THE PREFERRED EMBODIMENTS

Figure 1A:
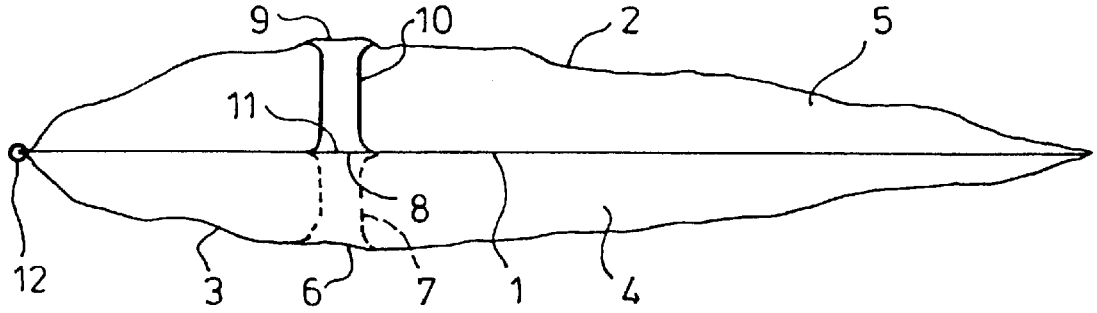
FIG. 1*a* is a cross sectional view of a mainsail, according to one aspect of the present invention.

According to one aspect of the present invention is a sail having an inner membrane and, on either side thereof, an outer membrane attached to the inner membrane, each outer membrane forming with the inner membrane an inflatable pocket. The camber of the inner membrane is less than that of the outer membranes, wherein an inflatable compartment is provided adjacent the luff edge of the sail. The camber of a membrane, according to various embodiments set forth herein, is the greatest perpendicular distance from the chord to the membrane, where the cord is an imaginary straight line extending from the luff edge of the sail to the leach when the membrane is at full extension.

Accordingly, when both the leeward inner membrane and an outer membrane are at their fullest extension, the sail adopts an airfoil cross section, the camber of the leeward surface being greater than the camber of the windward surface. In other words, the curvature of the leeward surface is greater than the curvature of the windward surface, producing an airfoil of significant thickness. This provides considerable improvement in the aerodynamic performance of the sail.

The inflatable compartment increases the thickness of the sail adjacent its luff edge so as to improve the aerodynamic efficiency of the sail.

An inflatable compartment may be located between the inner membrane and each of the outer membranes. The compartment may include sealable vent means which allow adjustment of the amount of air in the compartment. The inflatable compartment may comprise a pocket containing an inflatable tube. The width of the inflatable pocket may be approximately 30% of the chord of the sail. The pocket may be arranged to increase the sail thickness on the windward side, to modify the shape of the leeward pocket, and/or to increase the effective length of the sail's windward side.

Advantageously, the inner membrane is substantially impermeable to air and each pocket includes a vent arranged to permit the flow of air into and out of the pocket. The pockets may thus be inflated or deflated during use, as appropriate, or deflated for convenient storage of the sail.

Each vent preferably comprises a hole in one of the outer membranes of the sail, and means connecting the hole with the pocket formed by the inner membrane and the other outer membrane of the sail. As a result, the pocket on the leeward side of the sail may be filled and the pocket on the windward side may be evacuated by the pressure of the wind on the sail.

Preferably, the connecting means extend between the hole in the outer membrane and a corresponding hole in the inner membrane. The connecting means comprises, for example, a collapsible tube. When a pocket is flattened by wind incident the sail, the tube passing through the pocket also collapses.

The vents are preferably offset from one another. As a result, the pockets are isolated from one another and air cannot flow from one pocket into the other pocket.

Each vent is preferably situated approximately one third of the width of the sail from the luff edge of the sail. Because the pressure difference created across the sail during use is greatest in this region, the respective pockets are filled and evacuated quickly and efficiently.

Preferably, each hole in the outer membranes has associated means for preventing water such as spray and rain from entering the pockets, and hence the sail. Water can increase sail weight and distort its shape, thereby reducing sail performance.

Preferably, means are also provided for draining water from the pockets. The draining means may comprise a drain hole situated at the leach edge of the sail. Water that enters the sail is thereby quickly removed. Positioning the drain hole at the leach edge ensures that the drained water is blown clear of the sail.

In an alternative arrangement, the outer membranes are substantially impermeable to air and the inner membrane is adapted to allow air to flow through it from one pocket to the other. Such an arrangement does not require exterior vents and is therefore suitable for use on sailboards and in other situations where the sail is likely to be immersed in the water.

The inner membrane may be made of an air permeable material, may comprise a net or mesh, or may include one or more air vents. Preferably, the sail further includes a sealable vent for adjusting the quantity of air in the sail. When wind is incident the sail, the windward pocket is flattened and the air in the sail passes through the inner membrane and into the leeward pocket. This causes the sail to adopt an airfoil cross; section without the need for external air vents.

The sail preferably includes one or more flexible ribs that extend between the inner membrane and each outer membrane. The ribs may be shaped to hold the sail in a desired shape. The ribs preferably have the shape of an airfoil.

In addition, the ribs may be impermeable and divide the pockets into a plurality of compartments, each compartment including an air vent. In an alternative embodiment, the ribs divide the pockets into a plurality of compartments, the ribs being adapted to allow air to flow from one compartment to another. Each rib optionally includes one or more air vents or be made of an air permeable material, or a mesh or net-like material.

Advantageously, the ribs extend diagonally downward from the luff edge to the leach edge of the sail. A drain hole is provided at the lowermost corner of each associated compartment. In this manner, water flows downward toward the corner, improving drainage.

The outer membranes are preferably made of lighter weight material than the inner membrane. The outer membrane will thus lift easily away from the inner membrane and the sail will adopt readily a shape having a significant thickness.

The sail may further include means for stiffening the sail. The stiffening means may be provided in the inner membrane.

The present invention further provides a method of shaping a sail comprising an inner membrane and, on each side thereof, an outer membrane attached the inner membrane, each outer membrane forming, with the inner membrane, an inflatable pocket, the sail further including an inflatable compartment adjacent the luff edge, the method comprising inflating the compartment before use to increase the thickness of the sail adjacent the luff edge and inflating the pocket on the leeward side of the sail to increase the thickness of the sail.

Beneficially, each pocket includes an air vent. The leeward pocket is inflated by air flowing into the pocket through the air vent owing to the pressure differential created over the sail during use.

In another embodiment, the outer membranes are substantially impermeable to air and the inner membrane is adapted to allow air to flow through it from one pocket to the other. The sail is inflated before use. In use, air is transferred from the windward pocket to the leeward pocket, also owing to the pressure differential created across the sail.

Figure 1B:
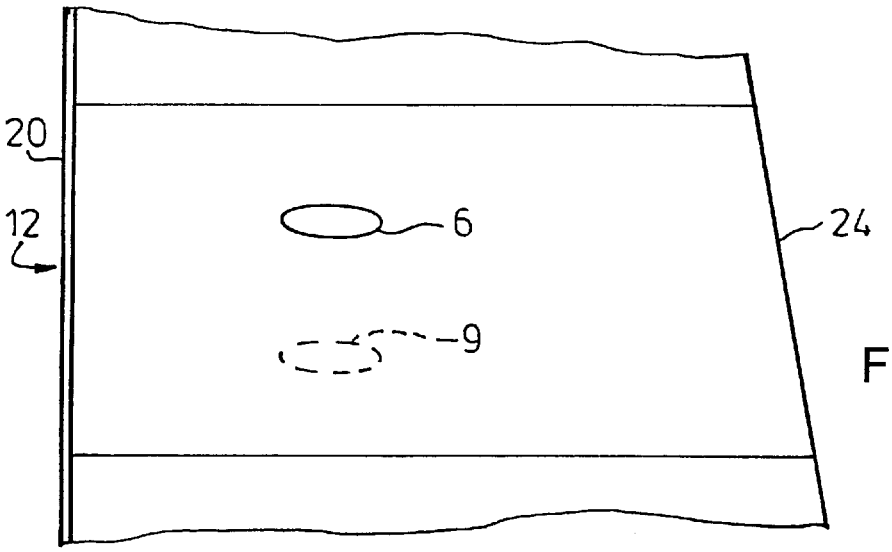
FIG. 1*b* is a partial plan view of the mainsail shown in FIG. 1*a;*

Referring now to the drawings and, more particularly, to FIGS. 1*a* and 1*b* there is shown a sail having improved aerodynamic characteristics. The sail comprises an inner membrane 1, a starboard outer membrane 2, and a port outer membrane 3. Outer membranes 2,3 are attached to the inner membrane substantially around their peripheries to form pockets 4,5 on either side of inner membrane 1. The inner membrane provides most of the strength of the sail and may be made of a standard sail material. The outer membranes may be made of a lighter weight material.

The width of each outer membrane 2,3 from the luff attachment point to the leach attachment point is greater at any height of the sail than the width of the inner membrane between those points. This allows the outer membranes to be spaced from the inner membrane, thereby increasing the thickness of the sail. The sail includes a bolt rope 12 at its luff edge for attachment in a conventional manner to a mast.

An air vent 6 in port outer membrane 3 is connected to starboard pocket 5 by a collapsible tube 7 of sail material which extends through port pocket 5 to a hole 8 in inner membrane 1. Similarly, an air vent 9 in starboard outer membrane 2 is connected to port pocket 4 by a collapsible tube 10 which extends through starboard pocket 5 to a second hole 11 in the inner membrane.

As shown in FIG. 1*b*, air vents 6,9 are situated approximately one third the distance from the luff edge to the leach edge of the sail, where the difference in air pressure across the sail is generally greatest during use. Holes 8,11 in the inner membrane are offset vertically from one another and the port and starboard pockets are thus isolated from one another, which prevents air from flowing through the sail from one side to the other.

Figure 1C:
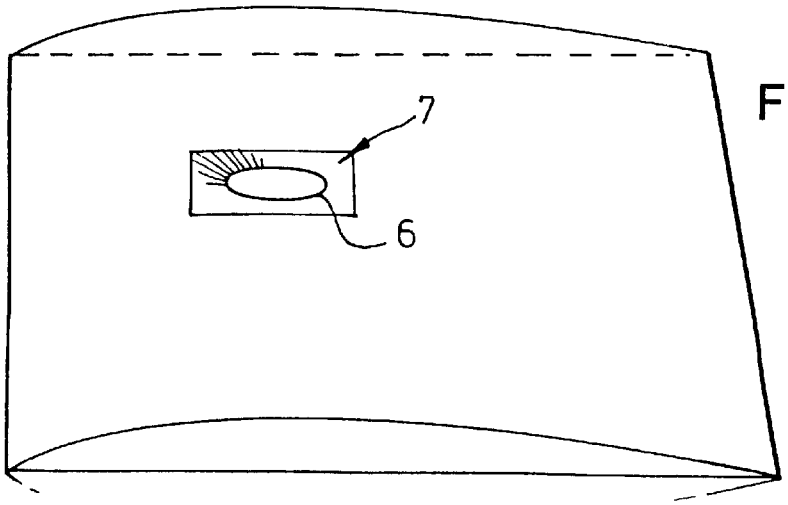
FIG. 1*c* is a partial plan view of a sail, according to another aspect of the present invention.

Collapsible tubes 7,10 may have concertina folds (not shown) and, as shown in FIG. 1*c*, are generally larger in cross section than associated vents. Tubes 7,10 are thus able to collapse without obstructing the associated air vents. The air vents may be elongated, as shown in FIG. 1*c*, and may be provided with cowls of fabric or a rigid material, to prevent spray or rain from entering.

FIGS. 2*a* and 2*b* show a mainsail having, on each side, a single pocket which extends over a substantial area of the sail. A single air vent 6,9 is provided on each side of the sail. The vents are vertically offset from one another and the pockets are thus isolated from one another.

The inner membrane of the sail is attached to mast 12*a* in a conventional manner by a bolt rope or slides. A drain hole 13 is provided at a lower corner of each pocket to allow drainage of water (for example, rain or spray) entering the pocket through the air vents. Halyard 14, outhaul 15 and tack tackle 16 are attached to the sail inner membrane in a conventional manner.

Referring now to FIGS. 3*a* and 3*b*, there is shown a sail in operation, the boat being on a port tack with the wind blowing in the direction indicated by arrow A, best seen in FIG. 3*a*. Starboard outer membrane 2 is thus located on the leeward (low pressure) side of the sail and port outer membrane 3 is located on the windward (high pressure) side of the sail.

The pressure difference across the sail causes air to flow through port air vent 6, associated tube 7 and hole 8, and into starboard pocket 5. The starboard pocket is thereby filled with air. The flow of air into the starboard pocket is indicated by arrow X. Simultaneously, air is evacuated from port pocket 4, through starboard air vent 9, and through tube 10 and hole 11, as indicated by arrow Y. Port outer membrane 3 thus lies in folds against inner membrane 1, the concertina folds allowing tube 7 to collapse and lie flat against inner membrane 1 without obstructing vent 6.

The width of the outer membranes as measured from the luff attachment point to the leach attachment point is generally greater at any height of the sail than the width of the inner membrane between those points. Accordingly, when the leeward pocket is filled with air, the camber of leeward outer membrane 2 is relatively greater than the camber of inner membrane 1. Put another way, the leeward outer membrane has a generally greater curvature (i.e., a smaller radius of curvature) than the inner membrane. Windward outer membrane 3, on the other hand, is pressed against the inner membrane 1, windward pocket 4 being evacuated. The sail adopts a thick airfoil cross section with a concave windward surface defined by the shape of the inner membrane and a convex leeward surface defined by the shape of the leeward outer membrane.

A reverse situation is shown in FIG. 3*b*. Here, the vessel is on a starboard tack with the wind blowing in the direction shown by arrow B. Port pocket 4 is now leeward and filled with air, and the starboard pocket is evacuated. The convex leeward surface is thus defined by the shape of port outer membrane 3. The concave windward surface is defined, for instance, by the shape of the inner membrane. In this manner, the sail is able to adopt a thick asymmetric airfoil cross section on either tack.

In use, the shape adopted by each of membranes 1,2,3 is determined by its material and cut (for example, the panel shapes, seam locations and so forth), and by the positioning of battens and other stiffening devices within the membrane. The shape of the sail's concave windward side is determined, for instance, by the shape of the inner membrane, as the windward outer membrane is pressed against the inner membrane. The shape of the convex leeward side of the sail is determined by the cut of the leeward outer membrane, which forms the other side of the air filled pocket.

When air enters the sail, the inner membrane and the leeward outer membrane adopt their full extension giving the sail an airfoil cross section of significant thickness. This provides considerable improvement in the aerodynamic performance of the sail. Further, the sail adopts an airfoil cross section regardless of the wind direction relative to the sail, and without the need for complex articulation. The sail is also foldable for easy storage and may be attached to a conventional mast.

Figure 4B:
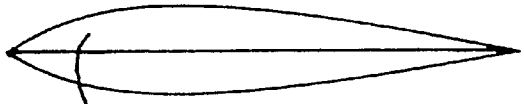
FIG. 4*b* is a sectional view taken along line IV—IV of FIG. 4*a;*
Figure 4A:
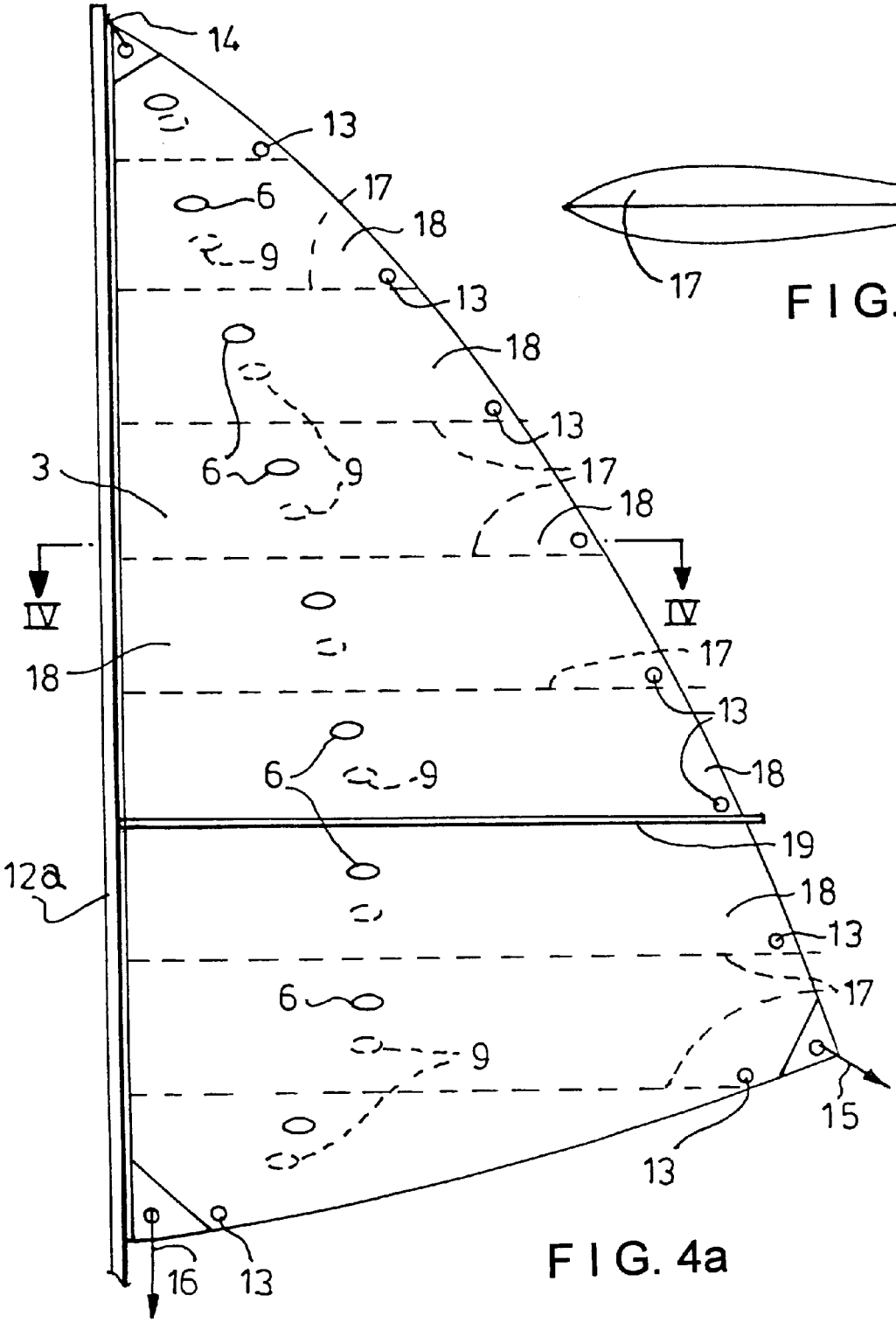
FIG. 4*a* is a plan view of a sail, in accordance with a further aspect of the present invention.

A further embodiment of the present invention is shown in FIGS. 4*a* and 4*b*. A hoisted mainsail is attached to mast 12*a*. The sail comprises inner membrane 1 and starboard and port outer membranes 2,3, which form pockets on either side of the inner membrane.

The pockets are divided into a number of separate compartments 18 by a plurality of fabric ribs 17. The ribs connect the inner membrane 1 to outer membranes 2,3 and extend horizontally from the luff edge of the sail to the leach edge. Each rib has an airfoil shape matching the desired airfoil cross section of the leeward pocket at the height of that rib. This helps to control the cross sectional shape of the leeward pocket. On the other hand, since the ribs are preferably made of fabric, they may collapse and lie substantially flat against the inner membrane when located on the windward side of the sail. It is preferred that the ribs be substantially impermeable, thereby isolating compartments 18 from one another. Separate air vents 6,9 are provided for each of the compartments.

Operation of the sail, including filling and evacuation of the pockets, is substantially as described with reference to FIGS. 3*a* and 3*b*. Air vents 6,9 in outer membranes 2,3 are situated approximately one third of the distance along the sail from luff edge 20, in order to benefit from the relatively high pressure difference across the sail in that region. This allows the pockets to be inflated and evacuated quickly and efficiently.

The ribs may be made of sail material or other air impervious material. A drain hole 13 at a lower corner of each compartment 18 allows water to drain therefrom. Drain holes 13 are sufficiently small to ensure that air pressure in the compartments is not reduced significantly by air escaping through the drain holes. Inner membrane 1 and/or outer membranes 2,3 may be provided with battens 19 or other stiffening means.

Figure 5:
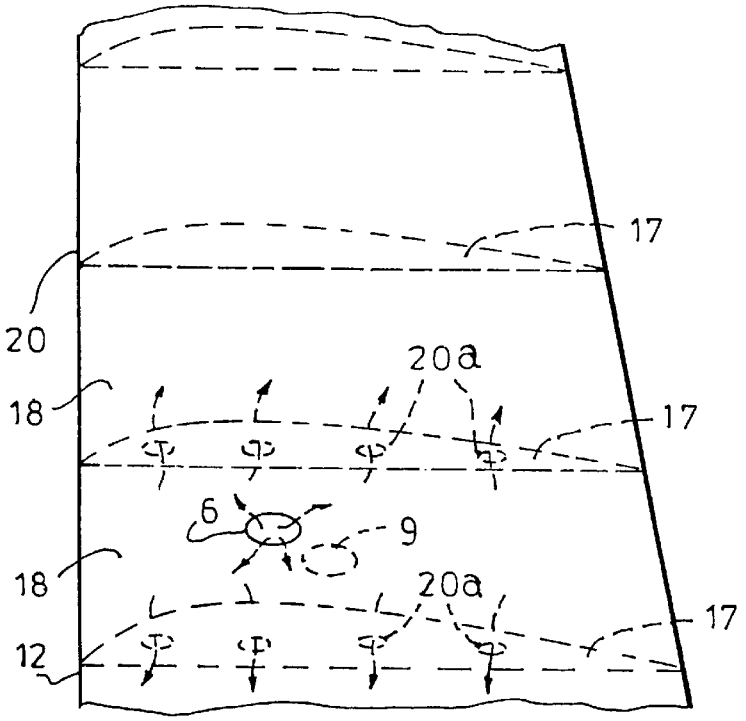
FIG. 5 is a partial plan view of the sail shown in FIG. 4*a* illustrating its internal construction.

A variant of the arrangement shown in FIGS. 4*a* and 4*b* is shown in FIG. 5. The pockets are again divided into a plurality of compartments 18 by ribs 17, but, in such arrangement, the ribs are provided with air holes 20. These holes allow air to flow from one compartment to another. Only one air vent 6,9 may therefore be required on each side of the sail to fill all the compartments in the pocket. Alternatively, the ribs are made of an air permeable material or a mesh or net. As in FIGS. 4*a* and 4*b*, the ribs control the shape of the airfoil cross section.

Figure 6B:
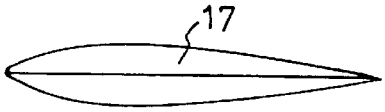
FIG. 6*b* is a sectional view takes along line VI—VI of FIG. 6*a;*
Figure 6A:
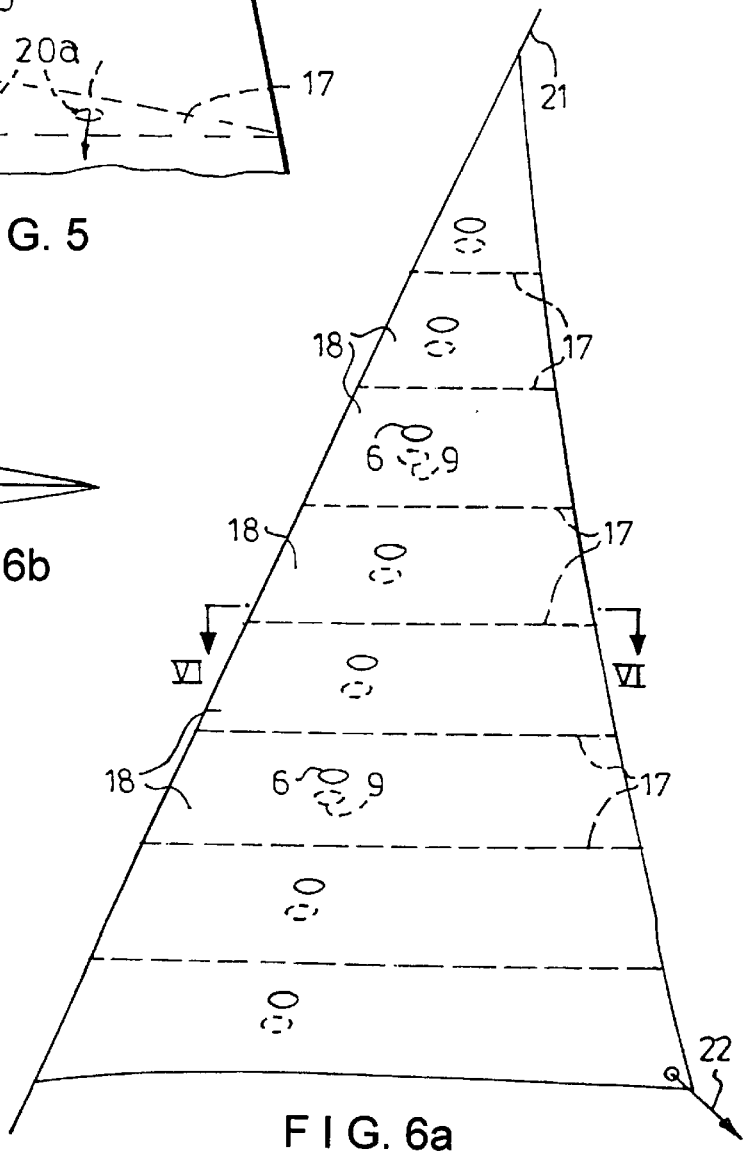
FIG. 6*a* is a plan side view of a jib or staysail, according to still another aspect of the present invention.

FIGS. 6*a* and 6*b* show a jib or staysail in which the pockets are also divided into a plurality of compartments 18 by ribs 17, each having separate vents 6,9. The construction of the sail corresponds to that of the mainsail shown in FIGS. 4*a* and 4*b*. The sail is attached to a forestay 21 and controlled by sheets 22 in a conventional manner.

Figure 7:
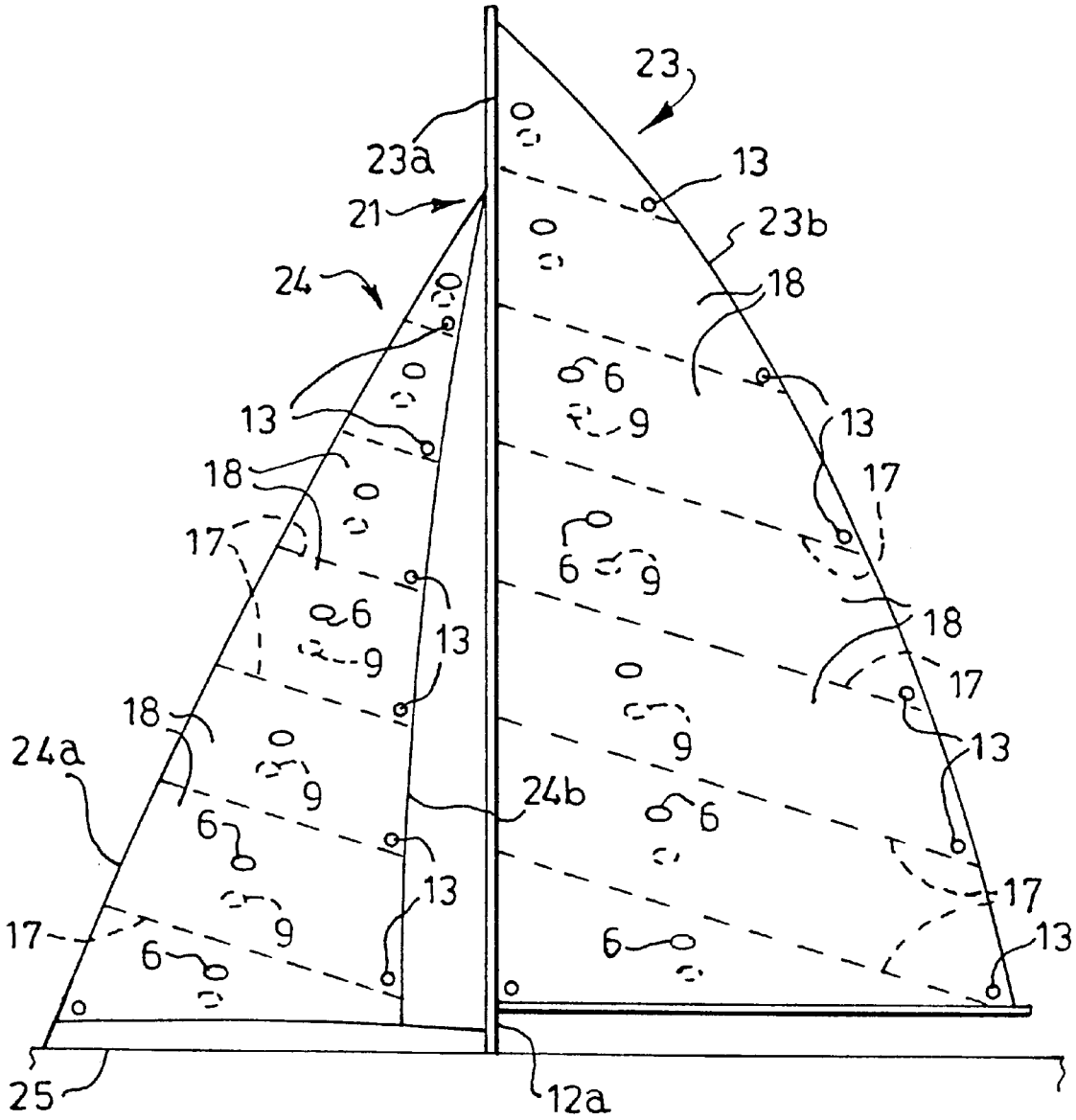
FIG. 7 is a partial plan view of a boat's rig showing a mainsail and jib, according to various aspects of the present invention.

FIG. 7 shows the rig of a sailing boat comprising a mainsail 23 and a jib 24. The sails are similar to those described with reference to FIGS. 4 and 6, except that here the ribs slope downward from luff edges 23*a*, 24*a* of the sails to leach edges 23*b*, 24*b* to improve flow of water to drain holes 13. The slope of the ribs is exaggerated in the drawing for clarity.

Figure 8B:
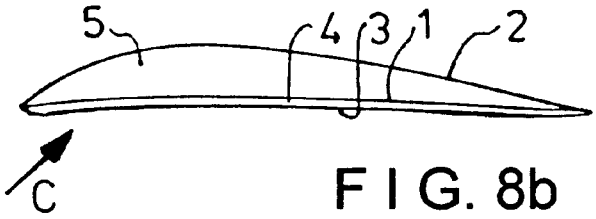
FIGS. 8*b* and 8*c* are alternative sectional views of the sail shown in FIG. 8*a;*
Figure 8C:
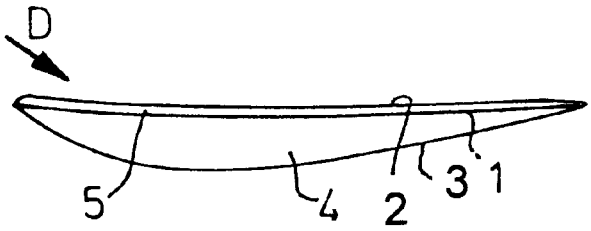
Figure 8A:
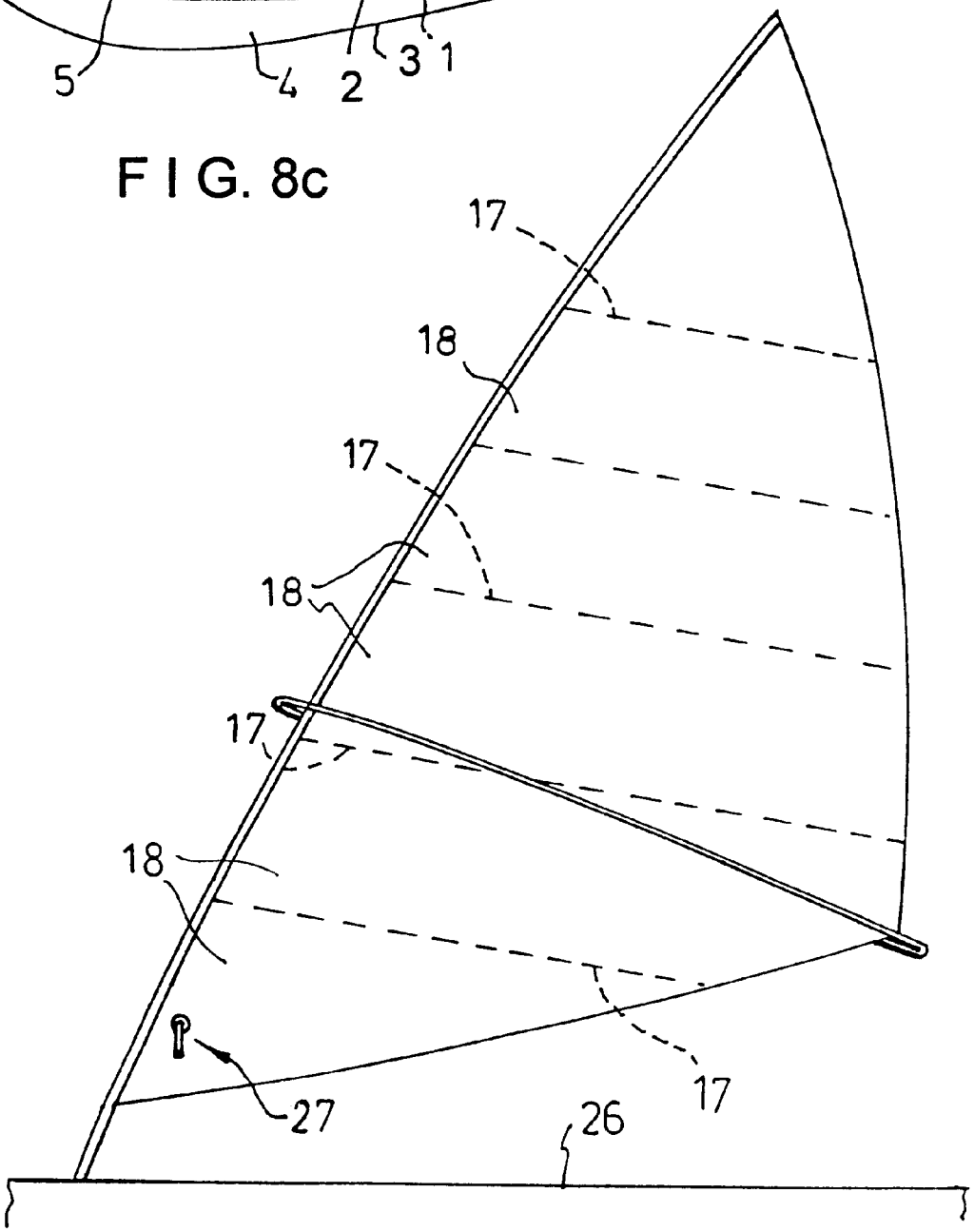
FIG. 8*a* is a plan view of a sailboard rig, in accordance with yet a further aspect of the present invention.

Turning now to FIGS. 8*a*, 8*b* and 8*c*, there are shown further examples of a sail which comprises two air impermeable outer membranes 2,3 and inner membrane 1. The inner membrane may include a vent or be made of a mesh or net-like material. As in the previous embodiments, the width of outer membranes 2,3 as measured from the luff edge of the sail to the leach edge is greater at any height than the width of the inner membrane. Although the sail is depicted in a form designed for use with a sailboard 26, it is understood that the sail may be adapted for use with other sailing vessels, giving consideration to the purpose for which the present invention is intended.

Outer membranes 2,3 preferably do not have any open external air vents and thus form a sealed envelope in which a quantity of air is trapped. The amount of air trapped in the sail may be adjusted using sealable air inlet 27, which comprises an inlet tube having a valve or closure. In this manner, the trapped air flows relatively freely through the permeable inner membrane from one pocket to the other.

The sail is similarly divided into a number of compartments by ribs 17, which connect the inner membrane to the two outer membranes and extend from the luff edge of the sail to the leach edge. The ribs are preferably made either of a permeable or net-like material, or include one or more holes which allow air to flow from one compartment to another. Alternatively, the ribs are impermeable and separate sealable air inlets are provided for each compartment.

The sail is inflated, before use, through inlet 27. The inlet is then sealed. The amount of air let into the sail depends on the sailing conditions and the desired characteristics of the sail, but generally will be approximately half the quantity needed to fill the sail.

The sail operates as shown in FIGS. 8*b* and 8*c*. When the sailboard is on a port tack with the wind blowing in the direction of arrow C (as shown in FIG. 8*b*), the pressure difference across the sail causes the air trapped within the sail to flow through permeable inner membrane 1 from windward port pocket 4 to leeward starboard pocket 5. Port outer membrane 3 thus collapses against the inner membrane and the starboard pocket expands to adopt an airfoil cross section. The shape of the airfoil cross section is thus determined by the inner membrane, which defines the shape of the sail's convex leeward side. The shape of the airfoil cross section is controlled additionally by the ribs. Battens or other stiffening devices may also be provided.

The shape of the sail may be varied during use, for example, by adjusting the amount of air trapped in the sail. As a result, the sail may be tuned for optimum performance according to different weather conditions.

If the sailboard changes onto a starboard tack with the wind blowing in the direction of arrow D (as shown in FIG. 8C), the air trapped in the sail is forced back through the permeable inner membrane from the windward starboard pocket into the leeward port pocket. Starboard outer membrane 2 then lies against the inner membrane. The sail is thus able to adopt an asymmetrical airfoil cross section on either tack.

Because the arrangement shown in FIGS. 8*a* to 8*c* is completely sealed and does not have any open external vents through which water can enter the sail, it is particularly suitable for sailboard sails, which are frequently immersed in the water. The sail might also be used on small dinghies, which are liable to capsize, or in conditions of heavy rain or spray. The sealed construction obviates the need for drain holes.

A number of variations and modifications of the sails described above are possible. For example, the outer membranes may extend over only part of the surface area of the inner membrane, such as the forward part of the sail, where the increased thickness has the most effect, or only the lower part of the sail. The outer membranes will always, however, have a greater camber than the inner membrane, so that the sail adopts, in use, a thick airfoil cross section.

Figure 9:
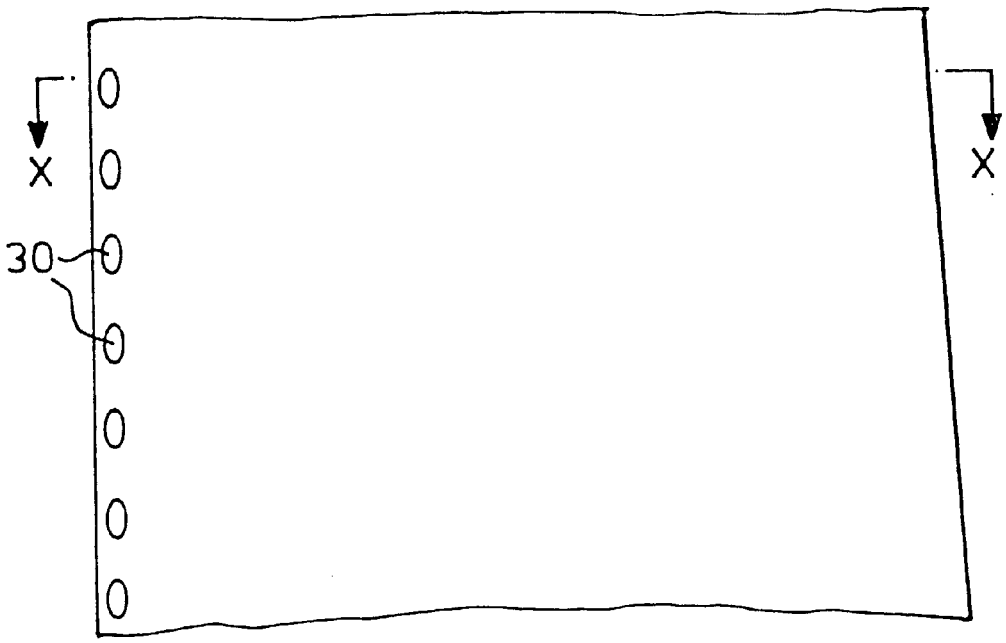
FIG. 9 is a partial plan view of a staysail, in accordance with still a further aspect of the present invention.
Figure 10A:
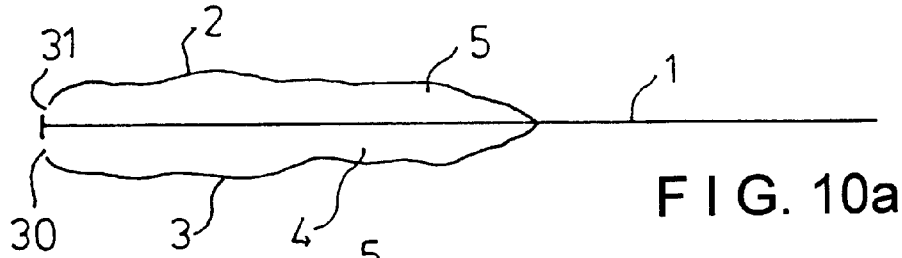
FIGS. 10*a*, 10*b* and 10*c* are sectional views taken along line X—X of FIG. 9.

A further example of a sail is shown in FIGS. 9 and 10. In this example, the sail has air vents 30,31 adjacent its luff edge, at or close to the region of maximum static pressure. This arrangement is suited particularly to jibs and staysails, where there is no mast to obstruct or shield the air vents from this region of high pressure.

Pockets 4,5 extend from the luff edge to approximately half the chord width of the sail, the maximum thickness of the airfoil section being located toward the leading edge of the sail.

Figure 10B:
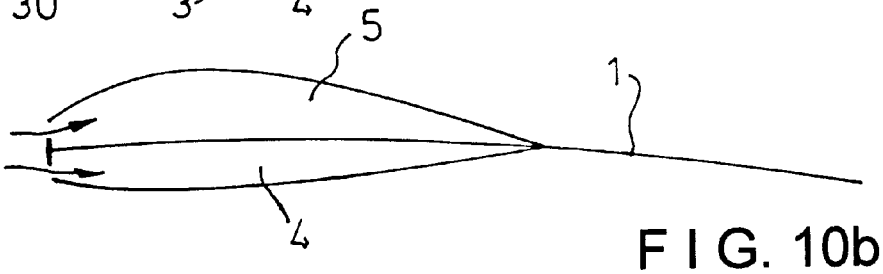
Figure 10C:
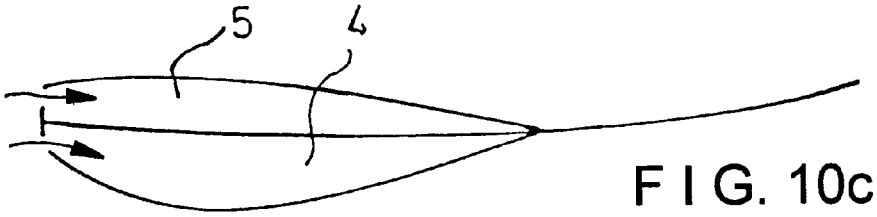

When the vessel is on a port tack, as shown in FIG. 10*b*, starboard pocket 5 is to leeward and completely inflated, owing to the difference in air pressure between leeward air vent 31 and the leeward surface of the sail. Windward port pocket 4 may also be partially inflated, giving an additional beneficial shaping to the leading edge of the sail. When the vessel is on a starboard tack, as shown in FIG. 10*c*, the situation is reversed. The leeward port pocket is fully inflated and the windward starboard pocket is partially inflated.

Figure 11:
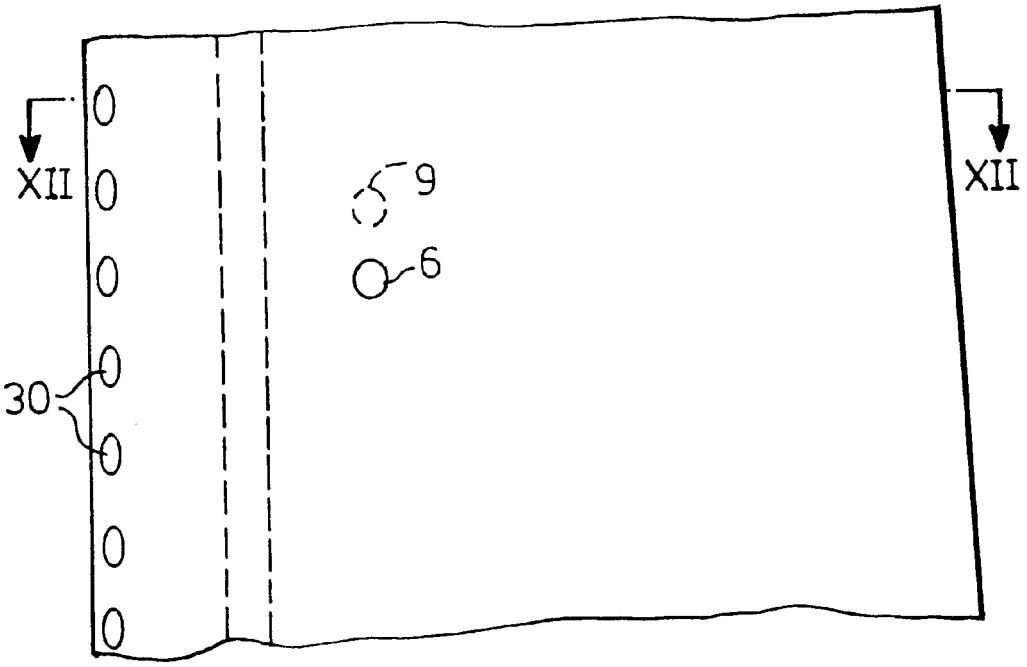
FIG. 11 is a partial plan view of a staysail, according to another aspect of the present invention.
Figure 12A:
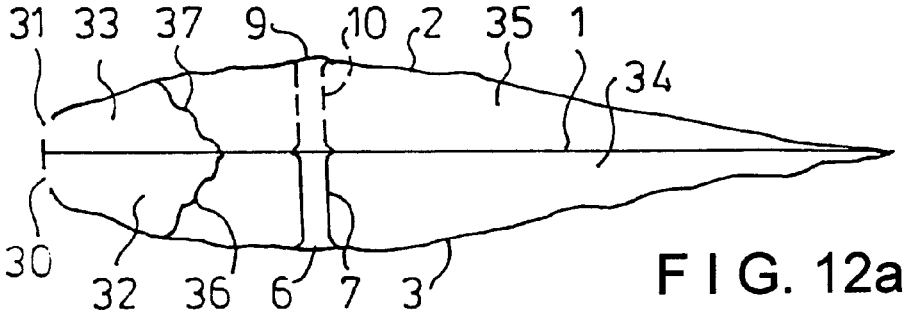
FIGS. 12*a* and 12*b* are sectional views taken along line XII—XII of FIG. 11.

According to a further embodiment, as shown in FIGS. 11 and 12, the features of the sail shown in FIGS. 9 and 10 are combined with those of the sail shown in FIG. 1. Each pocket 4,5 is divided into forward and rearward compartments 32,33,34,35 by a flexible impervious membrane 36,37. Forward compartment 32,33 of each pocket is inflated via an air vent 30,31 provided adjacent the leading edge of the sail, and rearward compartment 34,35 is inflated via a collapsible tube 7,10 that extends through the sail to a vent 6,9 located on the opposite side of the sail.

Figure 12B:
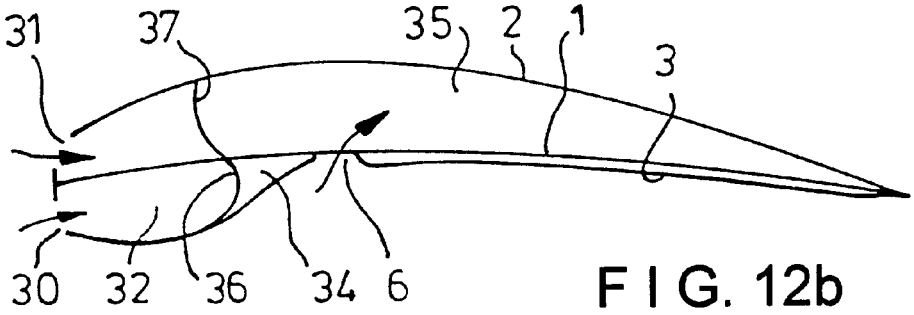
Figure 13:
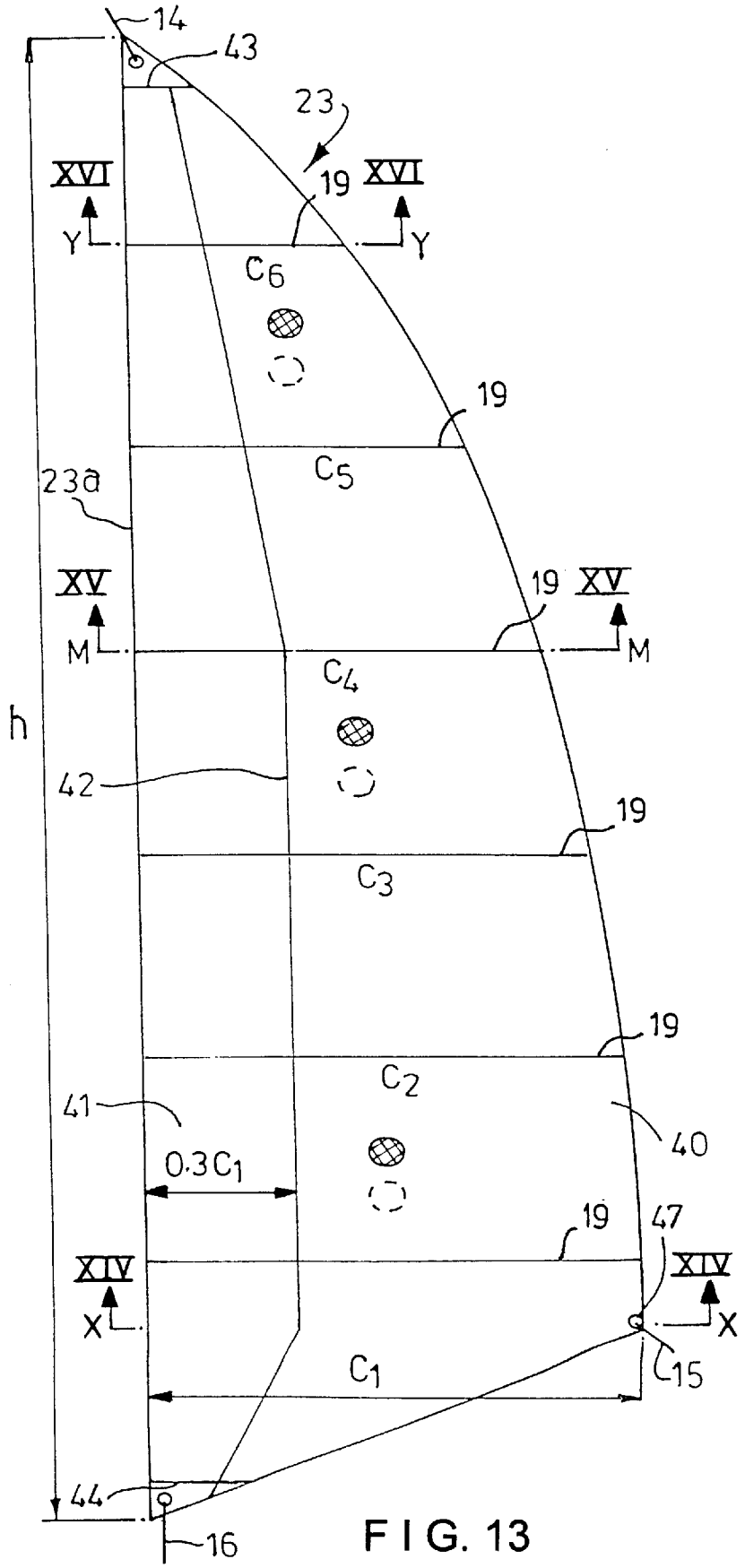
FIG. 13 is a plan view of a mainsail according to yet another aspect of the present invention.

When the vessel is on a port tack, as shown in FIG. 12*b*, both compartments 33,35 of the leeward starboard pocket are fully inflated and forward compartment 32 of the windward port pocket is partially inflated, thereby increasing the thickness of the sail's leading edge. Rearward compartment 34 of the windward pocket is almost completely evacuated, owing to the pressure difference between the two sides of the sail. Port membrane 3 lies against inner membrane 1 toward the rear of the sail and provides a smooth transition to the partially inflated forward compartment 32. This situation is reversed when the vessel is on a starboard tack.

Another aspect of the present invention is shown in FIGS. 13 to 16. In this embodiment, ribs are not provided and reliance is placed on the cut of the inner and outer membranes for the shape of the airfoil section. Inner and outer membranes 1,2,3 are connected to one another around the periphery of sail 23. Port and starboard pockets 4,5 extend over the entire height of the sail. Three vents 6,7 are provided for each pocket, such being located at approximately ¼, ½ and ¾ sail height. In practice, only one vent may be required for each pocket.

The inner membrane is fully battened, six battens 19 being provided in this case. Vents 40 are provided along the leach edge of the sail at each batten position, to allow air to exhaust from the windward pocket. Halyard 14, outhaul 15 and tack tackle 16 are attached to the inner membrane. The shape of the sail can be altered in conventional fashion by adjusting the tensions of the luff and the clew outhaul.

A pocket, hereinafter referred to as a luff pocket 41, is provided on each side of the sail, adjacent the luff edge. Luff pockets 41 are made of lightweight sail material and are attached to inner membrane 1 along luff edge 23*a* and along a seam 42 that extends over the entire height of the sail. Luff pockets 41 are located between the inner membrane and outer membranes 2,3. Each luff pocket 41 is open at the head and the foot of the sail, forming upper and lower apertures 43,44.

The luff pockets are designed to hold inflatable luff tubes 45. The luff tubes are preferably constructed of an impervious material (e.g., polythene sheet) and include sealable vents (not shown) through which they may be inflated. The tubes are inserted into the luff pockets and inflated, thereby producing rounded bulges on either side of the inner membrane, as shown in FIGS. 14*a* and 14*b*.

In the embodiment shown in the drawings, the luff pockets have a uniform width approximately 30% the maximum sail chord from the clew height up to approximately half the height of the sail. The pockets then taper uniformly toward the head of the sail. The lower ends of the pockets taper toward the foot of the sail.

A purpose of the luff pockets is to increase the thickness of the sail adjacent its luff edge on the windward side, so as to improve the sail's aerodynamic efficiency. The size and radius of the luff tubes are so designed that the effective length of the windward surface is equal to or very slightly greater than the effective length of the leeward surface at every section up the height of the sail. This ensures that any slack in the windward outer membrane is taken up, reducing drag.

Figure 16A:
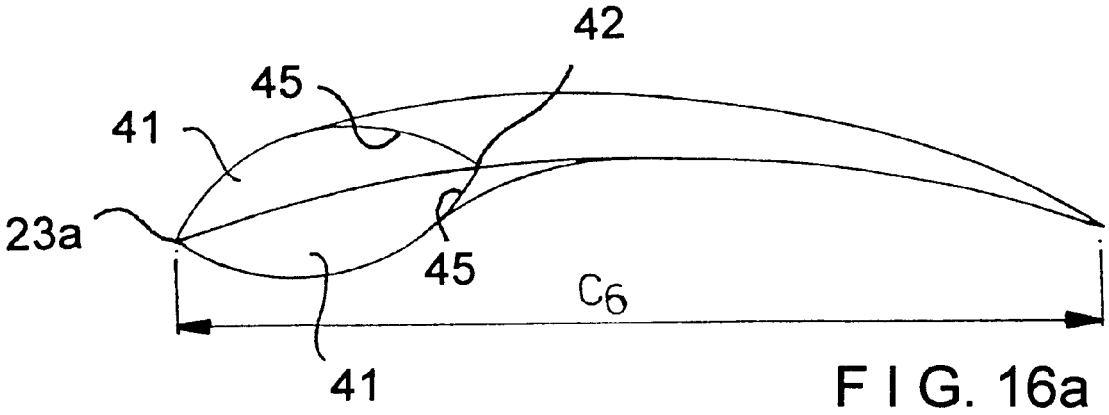
FIGS. 16*a*, 16*b* and 16*c* are sectional views taken along line XVI—XVI of FIG. 13, showing, respectively, sections of the complete sail, the inner membrane and luff tubes, and an outer membrane.
Figure 16B:
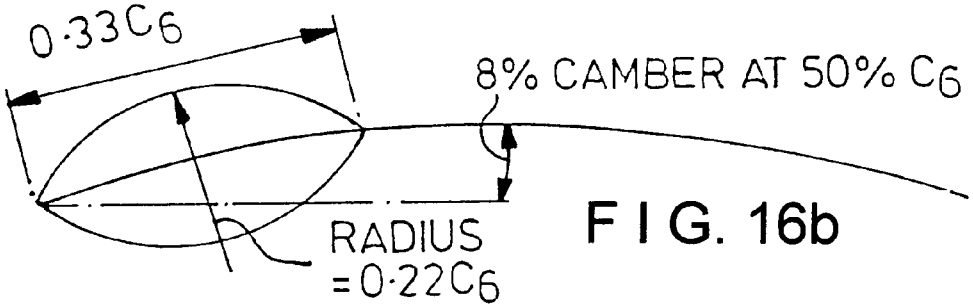
Figure 16C:
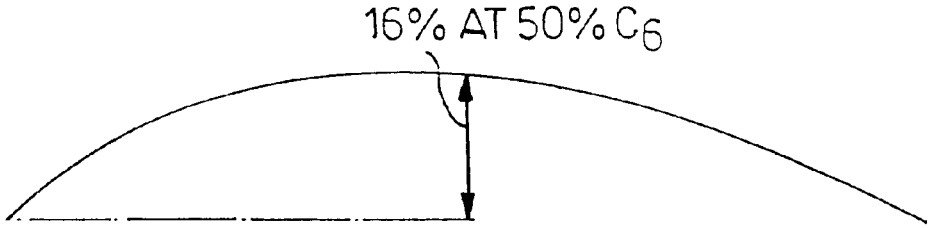

The desired shape of the sail at three different heights is shown, for illustrative purposes, in FIGS. 14, 15 and 16. FIGS. 14*a, b* and *c*, in turn, show a section through the sail at the height of clew 47. When the sail is fully stretched so as to produce maximum mast bend as measured, inner membrane 1 has a 4% camber at 50% chord and outer membrane 2 has a 10% camber at 40% chord. The camber of both surfaces increases as clew outhaul 15 is eased, allowing the mast to straighten. Luff pockets 41 have a width equal to $0.3C_1$ and a radius of curvature of $0.2C_1$, where $C_1$ is the length of the chord at clew height.

FIGS. 15*a, b* and *c* show a section through the sail at mid height, as measured from the clew to the head. Inner membrane 1 has a 6% camber at 50% chord and outer membrane 2 has a 14% camber at 45% chord. The camber of both surfaces increases slightly as the clew outhaul is eased, but not by as much at clew height. The width and the radius of the luff pockets are the same as at the clew height.

FIGS. 16*a, b* and *c* show sections at approximately 85% of sail height, as measured from clew 47. The inner membrane has an 8% camber and the outer membrane has a 16% camber, both at 50% chord. The luff pockets have a width of $0.33C_6$ and a radius of $0.22C_6$, where $C_6$ is the length of the chord at that height.

Luff tubes 45 are inserted into luff pockets 41 and inflated before use. During use, pocket 5 formed by inner membrane 1 and leeward outer membrane 2 becomes filled with air owing to the pressure differential across the sail, as shown in FIG. 14*a*. Windward pocket 4 collapses and outer membrane 3 is pressed against inner membrane 1 and windward luff pocket 41. The configuration is, of course, reversed when the vessel goes onto the other tack.

The windward side of the sail thus adopts a shape having a convex forward part and a concave rear part, whilst the leeward side is completely convex. The leeward luff pocket improves the shape of the leeward membrane by causing the position of maximum camber to form forward of the 50% chord position where it would otherwise naturally occur. The combined effects of the luff pockets provide a very efficient airfoil shape.

Figure 17:
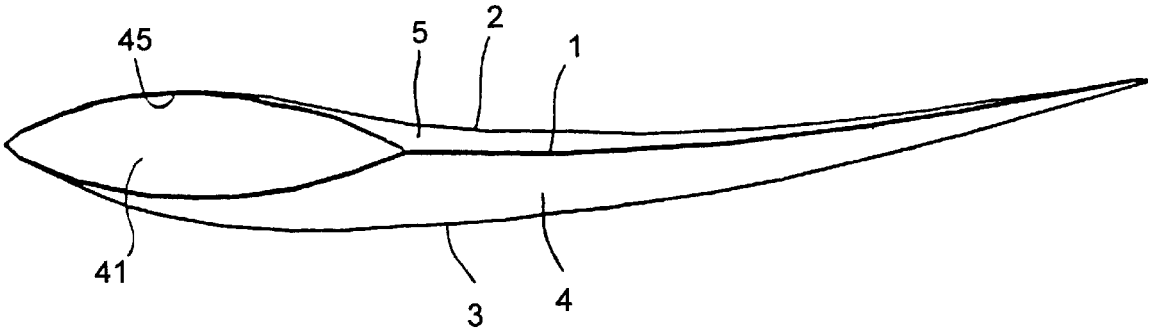
FIG. 17 is a cross sectional view of a sail according to a further embodiment of the present invention.

A further embodiment of the present invention is shown in FIG. 17. The inner membrane is made double thickness over approximately the leading third of the chord to form a single, central luff pocket 41. An inflatable luff tube 45 of an impervious material is inserted into luff pocket 41 and inflated to produce a rounded bulge adjacent the leading edge of the sail.

As in the previous embodiment, the purpose of the luff tube is to increase the thickness of the sail adjacent its luff edge, so improving the aerodynamic efficiency of the sail. The size and radius of the luff tube is so designed that the effective length of the windward surface is equal to or very slightly greater than that of the leeward surface, thus substantially eliminating slack in the windward outer member.

Certain possible modifications to the embodiments shown in FIGS. 13–17 will now be described. Instead of being attached to the inner membrane along luff edge 23*a* and seam 42, luff pockets 41 may be attached at their forward edges directly to the outer membranes. Alternatively, outer membranes 2,3 may be attached directly to the pockets. Both of these methods reduce the total amount of material in the sail.

The luff pockets may themselves be made of impermeable material and provided with sealable air vents, thereby obviating the need for separate luff tubes.

It is understood that a luff tube or tubes substantially as described with reference to FIGS. 13–17 may be incorporated into any of the sails shown in FIGS. 1*a*–12 and 18–21*a*, and that such sails are intended to be within the scope of the present invention.

Figure 18:
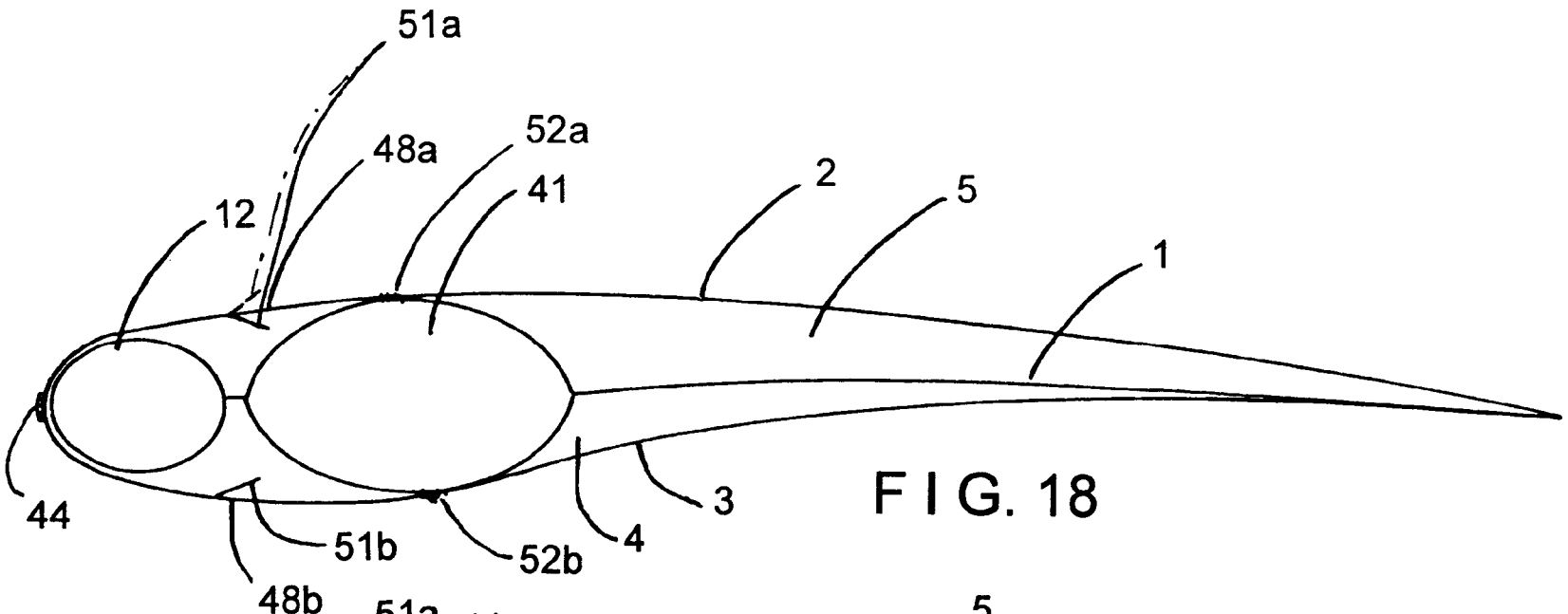
FIG. 18 is a cross sectional view of a mainsail according to another embodiment of the present invention.
Figure 19:
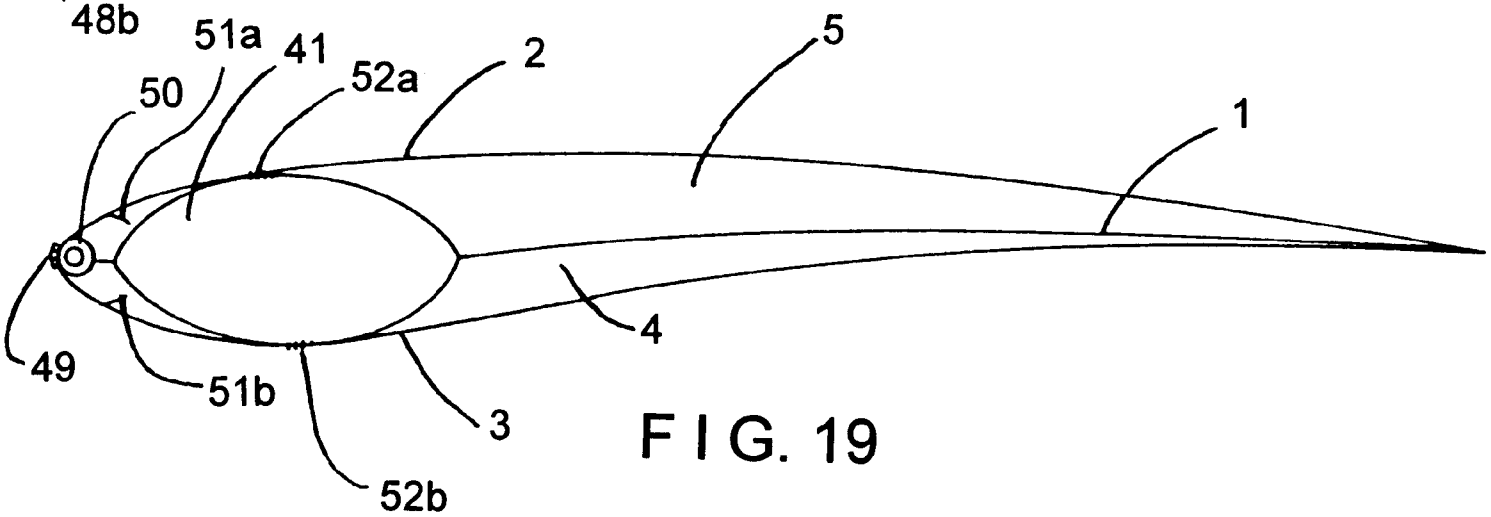
FIG. 19 is a cross sectional view of a foresail according to still another aspect of the present invention.
Figure 20:
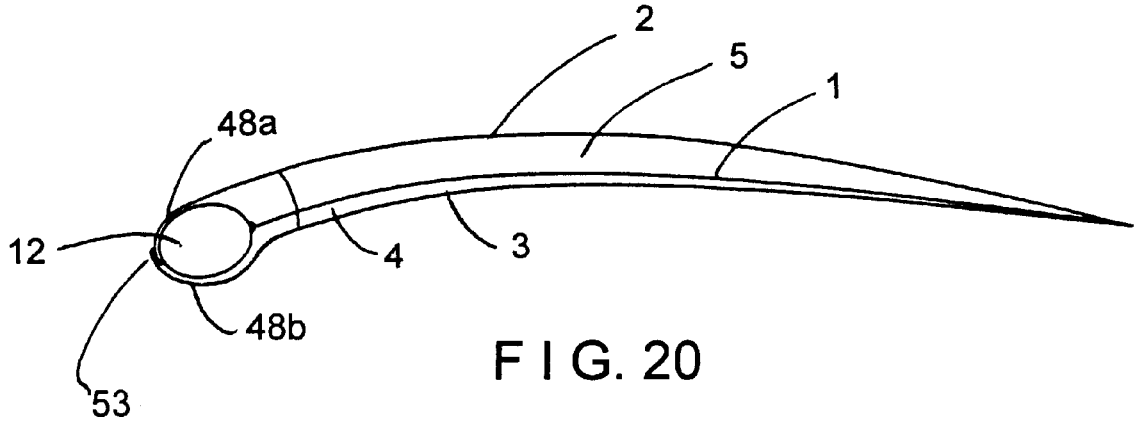
FIG. 20 is a cross sectional view of a sail according to yet another aspect of the present invention.

According to another embodiment of the present invention, as shown in FIGS. 18–20, is a sail which encloses either a mast or stay 12. For example, fairing flaps 48*a*,48*b* attached to one of the outer membranes, at the widest point of luff pocket 41, are selectively joined to the other outer membrane, down the front of the mast or forestay. Joining is accomplished by suitable fasteners such as zippers 49, hook and loop fabric 53 (for example VELCRO™) or the like. Alternatively, separate flaps on each side of the sail are used, similarly joined by zippers, hook and loop fabric or the like. According to another alternative embodiment, a single flap is attached to one side of the sail and goes around forestay 50 (or rollertube and luff foil 50), again zippered, fastened with hook and loop fabric or otherwise fastened suitably to the other side.

Preferably, the fairing flaps contain holes acting as air vents, with simple flaps 51*a*,51*b* over the holes on the inside surface, such that they operate as non-return valves. The fairing flaps are joined at 52*a*,52*b* to the mast, e.g., by stitching or glue. This arrangement effects pressure build up inside the volume created by the fairing flaps, distending the leeward flap, thereby improving the airfoil shape. It is desirable to allow the flaps to slide around the mast/forestay in response to tension of the leeward outer membrane.

Figure 21A:
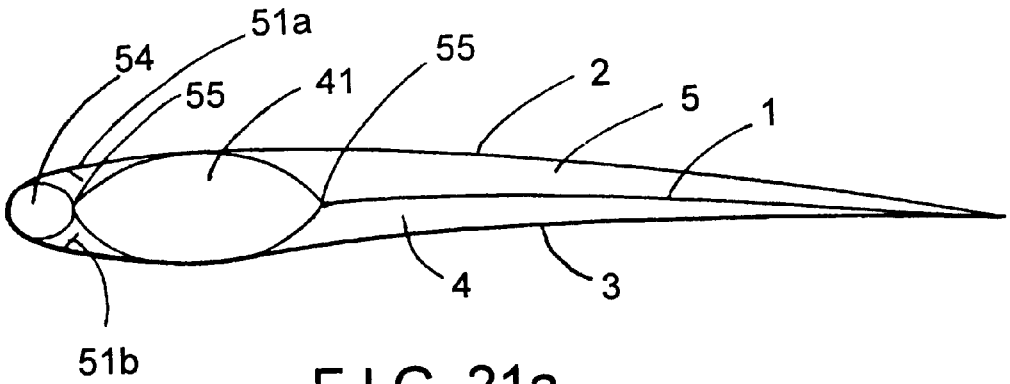
FIG. 21*a* is a cross sectional view of a sail according to yet a further aspect of the present invention.
Figure 21B:
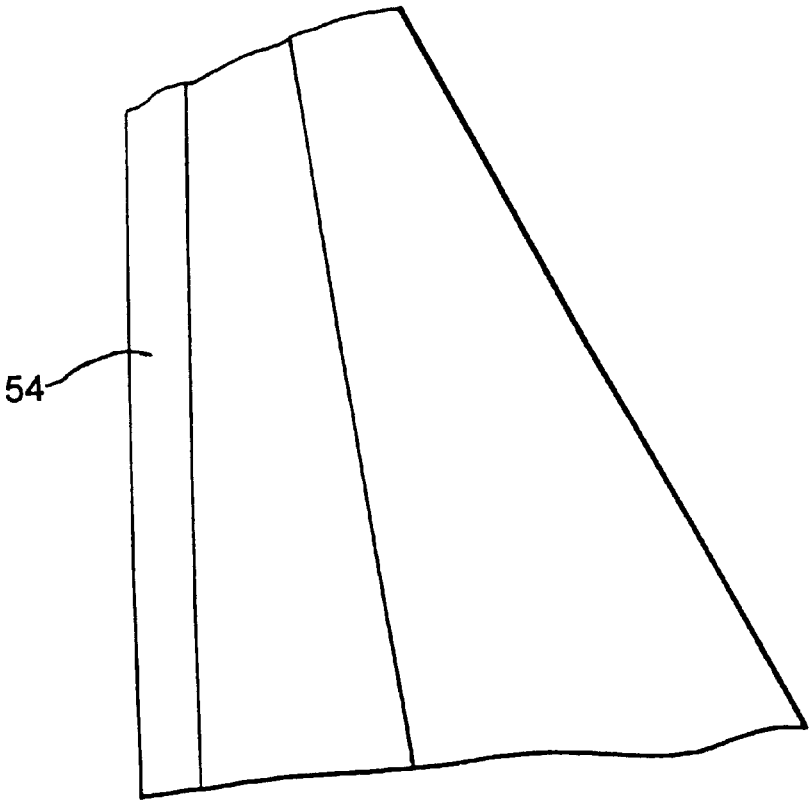
FIG. 21*b* is a partial plan view of the sail shown in FIG. 21*a*.

Alternatively, as shown in FIGS. 21*a* and 21*b*, there is provided an unstayed mast with an additional mast/forestay pocket. In particular, an open-ended pocket 54 is provided for the mast/forestay at the airfoil leading edge. A sealed, inflatable luff pocket 41 is also provided, seams of the pockets being joined by suitable fasteners 55 such as stitching.

Various modifications and alterations to the present invention may be appreciated based on a review of this disclosure. These changes and additions are intended to be within the scope and spirit of this invention as defined by the following claims.

What is claimed is:

1. A sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail.

2. The sail set forth in claim 1 wherein said sealable inflatable compartment is provided on a first side of the sail between the inner membrane and a first one of the outer membranes, and a second sealable inflatable compartment is provided adjacent the luff edge on a second side of the sail between the inner membrane and a second one of the outer membranes.

3. The sail set forth claim 1 wherein the sealable inflatable compartment comprises a pocket with an inflatable tube.

4. The sail set forth in claim 1 wherein the width of the sealable inflatable compartment is approximately 30% of the chord of the sail.

5. The sail set forth in claim 1 wherein the sealable inflatable compartment is arranged to increase the thickness of the sail on the windward side.

6. The sail set forth in claim 1 wherein the sealable inflatable compartment is arranged to modify the shape of the leeward pocket.

7. The sail set forth in claim 1 wherein the sealable inflatable compartment is arranged to increase the effective length of the windward side of the sail.

8. The sail set forth in claim 1 including means for draining water from the pocket.

9. The sail set forth in claim 1 wherein the outer membranes are made of a lighter weight material than the inner membrane.

10. The sail set forth in claim 1, including means for stiffening the sail.

11. A sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the outer membranes being substantially impermeable to air and the inner membrane being adapted to allow air to flow through it from one pocket to the other.

12. The sail set forth in claim 11, including a sealable vent for adjusting the quantity of air in the sail.

13. A sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the sail further including at least one flexible rib extending between the inner membrane and each outer membrane.

14. The sail set forth in claim 13 wherein the rib is impermeable and divides the pockets into a plurality of compartments, each compartment including an air vent.

15. The sail set forth in claim 13 wherein the rib divides the pockets into a plurality of compartments and allows air to flow from one compartment to another.

16. The sail set forth in claim 13 wherein the rib extends diagonally downward to the leach edge of the sail, drain holes being provided at the lowermost corner of each associated compartment.

17. A method of shaping a sail comprising an inner membrane and, on each side thereof, an outer membrane attached to the inner membrane, each outer membrane forming, with the inner membrane, an inflatable pocket, the sail further including a sealable inflatable compartment adjacent the luff edge, the method comprising inflating the sealable inflatable compartment before use to increase the thickness of the sail adjacent the luff edge and inflating the pocket on the leeward side of the sail by means of the pressure difference across the sail to increase the thickness of the sail.

18. The method set forth in claim 17 wherein each pocket includes an air vent, and the leeward pocket is inflated by air flowing into the pocket through the air vent owing to the pressure differential created during use across the sail.

19. The method set forth in claim 17 wherein the outer membranes of the sail are substantially impermeable to air and the inner membrane allows air to flow through it from one pocket to the other, the sail being inflated before use and air being transferred during use from the windward pocket to the leeward pocket owing to the pressure differential created across the sail.

20. A sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, at least one outer membrane having a fairing flap extending around a forward surface of a mast so as to form an airfoil leading edge at the mast forward surface.

21. A sail comprising an inner membrane and, on either side thereof, an outer membrane attached to the inner membrane, each outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, the at least one outer membrane having a fairing flap extending around a forward surface of a mast so as to form an airfoil leading edge at the mast forward surface, an open-ended pocket being positioned at the airfoil leading edge.

22. A sail comprising an inner membrane and, on either side thereof, an outer membrane attached to the inner membrane, each said outer membrane forming with the inner membrane an unsealed inflatable pocket into and from which air may flow, whereby, during use, the pressure difference across the sail causes the leeward pocket to be substantially inflated and the windward pocket to be substantially deflated, the camber of the inner membrane being less than that of the outer membranes, whereby, in use, the inner membrane at least partially supports the windward outer membrane, a sealable inflatable compartment being provided adjacent the luff edge of the sail, at least one outer membrane having a fairing flap extending around a forward surface of a forestay so as to form an airfoil leading edge.

23. A sail comprising an inner membrane and, on each side thereof, an outer membrane attached to the inner membrane, one of said outer members forming with one side of said inner membrane a first unsealed inflatable pocket into and from which air may flow, the other of said outer members forming with the other side of said inner membrane a second unsealed inflatable pocket into and from which air may flow;

whereby during use on a first tack, one of said pockets is the first-tack leeward pocket and the other of said pockets is the first-tack windward pocket, and the pressure difference across the sail causes the first-tack leeward pocket to be substantially inflated and the first-tack windward pocket to be substantially deflated; and further whereby during use on a second tack opposite to said first tack, said one of said pockets becomes the second-tack windward pocket and the other of said pockets becomes the second-tack leeward pocket, and the pressure-difference across the sail causes the second-tack leeward pocket to be substantially inflated and the second-tack windward pocket to be substantially deflated;

the camber of said inner membrane being less than that of said outer membranes;

whereby, in use, said inner membrane at least partially supports whichever one of the outer membranes is the windward outer membrane.

* * * * *